US010604719B2

(12) United States Patent
Kubo et al.

(10) Patent No.: US 10,604,719 B2
(45) Date of Patent: Mar. 31, 2020

(54) LUBRICATING OILS FOR AUTOMATIC TRANSMISSIONS

(71) Applicant: Chevron Japan Ltd., San Ramon, CA (US)

(72) Inventors: Koichi Kubo, Yokohama (JP); Masami Fuchi, Makinohara (JP); Takahiro Nakagawa, Makinohara (JP); Naoya Sasaki, Matsudo (JP); Satoshi Ohta, Matsudo (JP)

(73) Assignee: Chevron Japan LTD., Tokyo (JP)

( * ) Notice: Subject to any disclaimer, the term of this patent is extended or adjusted under 35 U.S.C. 154(b) by 0 days.

(21) Appl. No.: 15/902,080

(22) Filed: Feb. 22, 2018

(65) Prior Publication Data

US 2019/0256792 A1 Aug. 22, 2019

(51) Int. Cl.

| | |
|---|---|
| ***C10M 169/04*** | (2006.01) |
| ***C10M 101/00*** | (2006.01) |
| ***C10M 125/24*** | (2006.01) |
| ***C10M 133/44*** | (2006.01) |
| ***C10M 135/10*** | (2006.01) |
| ***C10M 137/04*** | (2006.01) |
| ***C10M 137/08*** | (2006.01) |
| ***C10M 141/10*** | (2006.01) |
| ***C10M 163/00*** | (2006.01) |

(52) U.S. Cl.

CPC ..... *C10M 169/04* (2013.01); *C10M 101/00* (2013.01); *C10M 125/24* (2013.01); *C10M 133/44* (2013.01); *C10M 135/10* (2013.01); *C10M 137/04* (2013.01); *C10M 137/08* (2013.01); *C10M 141/10* (2013.01); *C10M 163/00* (2013.01); *C10M 2201/085* (2013.01); *C10M 2203/003* (2013.01); *C10M 2203/1025* (2013.01); *C10M 2207/022* (2013.01); *C10M 2207/28* (2013.01); *C10M 2209/084* (2013.01); *C10M 2215/042* (2013.01); *C10M 2215/223* (2013.01); *C10M 2215/28* (2013.01); *C10M 2215/30* (2013.01); *C10M 2219/044* (2013.01); *C10M 2219/046* (2013.01); *C10M 2219/106* (2013.01); *C10M 2223/043* (2013.01); *C10M 2223/049* (2013.01); *C10N 2230/04* (2013.01); *C10N 2230/06* (2013.01); *C10N 2230/42* (2013.01); *C10N 2230/52* (2013.01); *C10N 2230/76* (2013.01); *C10N 2240/042* (2013.01); *C10N 2240/045* (2013.01)

(58) Field of Classification Search

None

See application file for complete search history.

(56) References Cited

U.S. PATENT DOCUMENTS

| | | | |
|---|---|---|---|
| 3,018,250 | A | 1/1962 | Anderson et al. |
| 3,018,291 | A | 1/1962 | Anderson et al. |
| 3,024,237 | A | 3/1962 | Drummond et al. |
| 3,100,673 | A | 8/1963 | Ulmer et al. |
| 3,172,892 | A | 3/1965 | Le Suer et al. |
| 3,202,678 | A | 8/1965 | Stuart et al. |
| 3,219,666 | A | 11/1965 | Norman et al. |
| 3,272,746 | A | 9/1966 | Le Suer et al. |
| 3,361,673 | A | 1/1968 | Stuart et al. |
| 3,362,673 | A | 1/1968 | Patch |
| 3,381,022 | A | 4/1968 | Le Suer |
| 3,912,764 | A | 10/1975 | Palmer, Jr. |
| 4,152,499 | A | 5/1979 | Boerzel et al. |
| 4,234,435 | A | 11/1980 | Meinhardt et al. |
| 4,612,132 | A | 9/1986 | Wollenberg et al. |
| 4,746,446 | A | 5/1988 | Wollenberg et al. |
| 4,747,965 | A | 5/1988 | Wollenberg et al. |
| 5,112,507 | A | 5/1992 | Harrison |
| 5,137,978 | A | 8/1992 | DeGonia et al. |
| 5,137,980 | A | 8/1992 | DeGonia et al. |
| 5,175,225 | A | 12/1992 | Ruhe, Jr. |
| 5,241,003 | A | 8/1993 | Degonia et al. |
| 5,266,186 | A | 11/1993 | Kaplan |
| 5,286,799 | A | 2/1994 | Harrison et al. |
| 5,319,030 | A | 6/1994 | Harrison et al. |
| 5,334,321 | A | 8/1994 | Harrison et al. |
| 5,356,552 | A | 10/1994 | Harrison et al. |
| 5,523,417 | A | 6/1996 | Blackborow et al. |
| 5,565,528 | A | 10/1996 | Harrison et al. |
| 5,616,668 | A | 4/1997 | Harrison et al. |
| 5,625,004 | A | 4/1997 | Harrison et al. |
| 5,716,912 | A | 2/1998 | Harrison et al. |
| 5,777,025 | A | 7/1998 | Spencer et al. |
| 5,792,729 | A | 8/1998 | Harrison et al. |

(Continued)

FOREIGN PATENT DOCUMENTS

| | | |
|---|---|---|
| EP | 355895 | 2/1990 |
| EP | 542380 | 5/1993 |
| EP | 602863 | 6/1994 |

OTHER PUBLICATIONS

Mortier et al., "Chemistry and Technology of Lubricants," 2nd Edition, London, Springer, Chapters 1 and 2 (1996).

A. Sequeria, Jr., "Lubricant Base Oil and Wax Processing," New York, Marcel Decker, Chapter 6, (1994).

Leslie R. Rudnick, "Lubricant Additives: Chemistry and Applications," New York, Marcel Dekker, Chapter 8, pp. 223-258 (2003).

Mortier et al., "Chemistry and Technology of Lubricants," 2nd Edition, London, Springer, Chapter 6, pp. 190-193 (1996).

Mortier et al., "Chemistry and Technology of Lubricants ," 2nd Edition, London, Springer, Chapter 3, pp. 75-85 (1996).

Leslie R. Rudnick, "Lubricant Additives: Chemistry and Applications," New York, Marcel Dekker, Chapter 4, pp. 113-136 (2003).

(Continued)

*Primary Examiner* — Vishal V Vasisth

(74) *Attorney, Agent, or Firm* — Ryan, Mason & Lewis, LLP

(57) ABSTRACT

The present invention generally relates to lubricating oil compositions useful for automatic transmissions, and particularly transmission oils for automotive automatic transmissions and/or continuously variable transmissions using wet clutch systems, in particular wet paper clutch containing a small amount of cellulose fiber and/or aramid fiber.

20 Claims, No Drawings

(56) References Cited

U.S. PATENT DOCUMENTS

| | | | | |
|---|---|---|---|---|
| 6,165,235 | A | 12/2000 | Kolp et al. | |
| 2009/0275491 | A1* | 11/2009 | Komatsubara | C10M 163/00 508/192 |
| 2009/0305919 | A1* | 12/2009 | Tipton | C10M 163/00 508/162 |
| 2016/0281022 | A1* | 9/2016 | Yamamoto | C10M 141/10 |

OTHER PUBLICATIONS

Leslie R. Rudnick, "Lubricant Additives: Chemistry and Applications," New York, Marcel Dekker, Chapter 1, pp. 1-28 (2003).
Mortier et al., "Chemistry and Technology of Lubricants," 2nd Edition, London, Springer, Chapter 6, pp. 187-189 (1996).
Leslie R. Rudnick, "Lubricant Additives: Chemistry and Applications," New York, Marcel Dekker, Chapter 11, pp. 329-354 (2003).

* cited by examiner

LUBRICATING OILS FOR AUTOMATIC TRANSMISSIONS

FIELD OF THE INVENTION

The present invention generally relates to lubricating oil compositions useful for automatic transmissions, and particularly transmission oils for automotive automatic transmissions and/or continuously variable transmissions using wet clutch system, in particular wet paper clutch containing a small amount of cellulose fiber and/or aramid fiber.

BACKGROUND OF THE INVENTION

Lubricating oils for automatic transmissions, called automatic transmission fluids, have been used conventionally to assist smooth operation of automatic transmissions which are installed in automobiles and include a torque converter, a gear mechanism, a wet clutch, and a hydraulic mechanism.

It is well known that lubricant additives give effects on the friction properties of wet clutch and steel plates. Additive effects are caused by both their physical and chemical absorption on clutch materials, ex. cellulose, aramid (a natural and synthesized) fibers, silica and steel plate surface. There has been an Industry drive to change from cellulose rich to aramid rich wet clutch papers for use in in automotive automatic transmissions. The ratio of cellulose and aramid is important for thermal and oxidation stability performance of wet clutches. High aramid wet clutch paper shows excellent durability performance. However, the cost of aramid fiber is high.

Further, regulatory changes have resulted in modem vehicles being required to have improved fuel economy and reduced $CO_2$ emissions to prevent global warming. In addition to improvements in the design of engine and transmission systems, lubricant performance has also been required to address this issue. In the case of automotive automatic transmissions, power loss caused by the torque converter in a starting time need to be minimized, and lock up clutch systems have been introduced to improve fuel efficiency. Lock up torque converters are installed in lock-up wet paper clutches in the torque converter systems. These can reduce power loss and provide excellent fuel economy, because they can engage the wet clutches after fluid coupling at low speeds and a shorter time.

On the lubricant side, having the right lubricant for an automatic transmission with lock up paper wet clutch in the transmission is also very important. If a lubricant gives poor torque capacities and anti-shudder friction performance, power loss or uncomfortable vibration with high noise from lock-up of the wet clutch in the transmission would occur. Thus, lubricants for an automatic transmission with lock up paper wet clutch systems should provide both good fuel economy and smooth driving and operating condition.

The inventors have discovered a lubricating oil composition which has excellent wet paper clutch friction characteristics, such as anti-shudder performance, and which can also maintain excellent wet clutch torque capacity and durability of wet clutch friction characteristics.

SUMMARY OF THE INVENTION

In accordance with one embodiment of the present invention, provided is a lubricating oil composition comprising:

i) a major amount of oil of lubricating viscosity, ii) at least one or more non-post treated succinimide dispersant, iii) 0.01-0.5 wt. % phosphoric acid, iv) a metal detergent providing no more than 350 ppm of metal to the composition, v) at least one or more organic phosphorus compound, wherein the ratio of nitrogen from the non-post treated succinimide to the phosphorous from phosphoric acid is 1 to 3.

In accordance with another embodiment of the present invention, provided is a method of improving anti-shudder performance and reducing friction in a combustion engine equipped with an automatic transmission or a continuously variable transmission comprising lubricating said transmission with a lubricating oil composition comprising:

i) a major amount of oil of lubricating viscosity, ii) at least one or more non-post treated succinimide dispersant, iii) 0.01-0.5 wt. % phosphoric acid, iv) a metal detergent providing no more than 350 ppm of metal to the composition, v) at least one or more organic phosphorus compound, wherein the ratio of nitrogen from the non-post treated succinimide to the phosphorous from phosphoric acid is 1 to 3.

DETAILED DESCRIPTION OF THE INVENTION

Definitions:

The following terms will be used throughout the specification and will have the following meanings unless otherwise indicated.

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

The term "Total Base Number" or "TBN" refers to the level of alkalinity in an oil sample, which indicates the ability of the composition to continue to neutralize corrosive acids, in accordance with ASTM Standard No. D2896 or equivalent procedure. The test measures the change in electrical conductivity, and the results are expressed as mgKOH/g (the equivalent number of milligrams of KOH needed to neutralize 1 gram of a product). Therefore, a high TBN reflects strongly overbased products and, as a result, a higher base reserve for neutralizing acids.

The term "PIB" refers to poly-isobutylene.

The Oil of Lubricating Viscosity

The lubricating oil compositions disclosed herein generally comprise at least one oil of lubricating viscosity. Any base oil known to a skilled artisan can be used as the oil of lubricating viscosity disclosed herein. Some base oils suitable for preparing the lubricating oil compositions have been described in Mortier et al., "*Chemistry and Technology of Lubricants,*" 2nd Edition, London, Springer, Chapters 1 and 2 (1996); and A. Sequeria, Jr., "*Lubricant Base Oil and Wax Processing*," New York, Marcel Decker, Chapter 6, (1994); and D. V. Brock, *Lubrication Engineering*, Vol. 43, pages 184-5, (1987), all of which are incorporated herein by reference. Generally, the amount of the base oil in the lubricating oil composition may be from about 70 to about 99.5 wt. %, based on the total weight of the lubricating oil composition. In some embodiments, the amount of the base oil in the lubricating oil composition is from about 75 to about 99 wt. %, from about 80 to about 98.5 wt. %, or from about 80 to about 98 wt. %, based on the total weight of the lubricating oil composition.

In certain embodiments, the base oil is or comprises any natural or synthetic lubricating base oil fraction. Some non-limiting examples of synthetic oils include oils, such as polyalphaolefins or PAOs, prepared from the polymerization of at least one alpha-olefin, such as ethylene, or from hydrocarbon synthesis procedures using carbon monoxide and hydrogen gases, such as the Fisher-Tropsch process. In certain embodiments, the base oil comprises less than about 10 wt. % of one or more heavy fractions, based on the total weight of the base oil. A heavy fraction refers to a lube oil fraction having a viscosity of at least about 20 cSt at 100° C. In certain embodiments, the heavy fraction has a viscosity of at least about 25 cSt or at least about 30 cSt at 100° C. In further embodiments, the amount of the one or more heavy fractions in the base oil is less than about 10 wt. %, less than about 5 wt. %, less than about 2.5 wt. %, less than about 1 wt. %, or less than about 0.1 wt. %, based on the total weight of the base oil. In still further embodiments, the base oil comprises no heavy fraction.

In certain embodiments, the lubricating oil compositions comprise a major amount of a base oil of lubricating viscosity. In some embodiments, the base oil has a kinematic viscosity at 100° C. from about 1.5 centistokes (cSt) to about 20 cSt, from about 2 centistokes (cSt) to about 20 cSt, or from about 2 cSt to about 16 cSt. The kinematic viscosity of the base oils or the lubricating oil compositions disclosed herein can be measured according to ASTM D 445, which is incorporated herein by reference.

In other embodiments, the base oil is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock shall be substantially free from materials introduced through manufacturing, contamination, or previous use.

In some embodiments, the base oil comprises one or more of the base stocks in one or more of Groups I-V as specified in the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV.

In some embodiments, the base oil comprises one or more of the base stocks in Group I, II, III, IV, V or a combination thereof. In other embodiments, the base oil comprises one or more of the base stocks in Group II, III, IV or a combination thereof. In further embodiments, the base oil comprises one or more of the base stocks in Group II, III, IV or a combination thereof wherein the base oil has a kinematic viscosity from about 1.5 centistokes (cSt) to about 20 cSt, from about 2 cSt to about 20 cSt, or from about 2 cSt to about 16 cSt at 100° C. In some embodiments, the base oil is a Group II baseoil.

The base oil may be selected from the group consisting of natural oils of lubricating viscosity, synthetic oils of lubricating viscosity and mixtures thereof. In some embodiments, the base oil includes base stocks obtained by isomerization of synthetic wax and slack wax, as well as hydrocrackate base stocks produced by hydrocracking (rather than solvent extracting) the aromatic and polar components of the crude. In other embodiments, the base oil of lubricating viscosity includes natural oils, such as animal oils, vegetable oils, mineral oils (e.g., liquid petroleum oils and solvent treated or acid-treated mineral oils of the paraffinic, naphthenic or mixed paraffinic-naphthenic types), oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In some embodiments, the synthetic oils of lubricating viscosity include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof wherein the terminal hydroxyl groups can be modified by esterification, etherification, and the like. In further embodiments, the synthetic oils include the esters of dicarboxylic acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyakyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In further embodiments, the base oil comprises a poly-alpha-olefin (PAO). In general, the poly-alpha-olefins may be derived from an alpha-olefin having from about 1.5 to about 30, from about 2 to about 20, or from about 2 to about 16 carbon atoms. Non-limiting examples of suitable poly-alpha-olefins include those derived from octene, decene, mixtures thereof, and the like. These poly-alpha-olefins may have a viscosity from about 1.5 to about 15, from about 1.5 to about 12, or from about 1.5 to about 8 centistokes at 100° C. In some instances, the poly-alpha-olefins may be used together with other base oils such as mineral oils.

In further embodiments, the base oil comprises a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono- and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil comprises any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil comprises a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a rerefined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

Nitrogen-Containing Ashless Succinimide Dispersant

In one aspect, one or more nitrogen-containing ashless succinimide dispersant(s) is/are present in the lubricating oil composition. In one aspect, the one or more nitrogen-containing ashless succinimide dispersant is a non post treated dispersant.

Typical examples of the nitrogen-containing ashless dispersant include alkenyl or alkyl succinimides derived from polyolefins, and derivatives thereof. A succinimide can be obtained by a reaction between a succinic anhydride substituted with a high molecular weight alkenyl or alkyl group, and a polyalkylenepolyamine containing an average of 3 to 10 (and preferably 4 to 7) nitrogen atoms per molecule. In one aspect, the high molecular weight alkenyl or alkyl group is preferably a polyolefin with a number average molecular weight of approximately 900 to 5000, with polybutene being particularly favorable. In one aspect, the high molecular weight alkenyl or alkyl group is preferably a polyolefin with a number average molecular weight of from 900 to 4000, from 900 to 3500, 900 to 3000, 900 to 2500, 900 to 2000, 900 to 1500, 900 to 1000, 90 to 1000, 1000.

In some aspects, a chlorination method in which chlorine is used is utilized in the step of obtaining a polybutenyl succinic anhydride by a reaction between polybutene and maleic anhydride. With this method, however, although reactivity is good, a large amount of chlorine (such as about 2000 ppm) ends up remaining in the final succinimide product. On the other hand, if a thermal reaction is used in which no chlorine is involved, the amount of chlorine remaining in the final product can be kept to a very low level (such as 40 ppm or less). Also, compared to conventional polybutene (primarily one having a β-olefin structure), using highly reactive polybutene (one in which at least about 50% has a methyl vinylidene structure) is advantageous in that reactivity is increased even with a thermal reaction method. If reactivity is high, there will be less unreacted polybutene in the dispersant, so a dispersant with a high concentration of active component (succinimide) can be obtained. Therefore, it is preferable to manufacture a succinimide by first obtaining a polybutenyl succinic anhydride by thermal reaction using highly reactive polybutene, and then reacting this polybutenyl succinic anhydride with a polyamine. The succinimide can be used in the form of what is called a modified succinimide, by further reacting with boric acid, an alcohol, an aldehyde, a ketone, an alkylphenol, a cyclic carbonate, an organic acid, or the like. A boron-containing alkenyl (or alkyl) succinimide obtained by a reaction with boric acid or a boron compound is particularly advantageous in terms of thermal and oxidation stability. Succinimides come in mono, bis, and poly types, according to the number of imide structures per molecule, but bis types are preferable as the succinimide used for the purpose of the present invention.

Other examples of nitrogen-containing ashless dispersants include polymeric succinimide dispersants derived from an ethylene-α-olefin copolymer (such as one with a molecular weight of 1000 to 15,000), and alkenylbenzylamine-based ashless dispersants.

Particularly preferred nitrogen-containing ashless dispersants are mono and bis alkyl or alkenyl succinimides derived from the reaction of alkyl or alkenyl succinic acid or anhydride and alkylene polyamines. These compounds are generally considered to have the formula (I)

Formula I

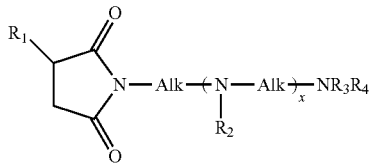

wherein $R_1$ is a substantially hydrocarbon chain having a molecular weight from about 450 to 3000, that is, $R_1$ is a hydrocarbyl chain, preferably an alkenyl radical, containing about 30 to about 200 carbon atoms; Alk is an alkylene chain of 2 to 10, preferably 2 to 6, carbon atoms, $R_2$, $R_3$, and $R_4$ are selected from a $C_1$-$C_4$ alkyl or alkoxy or hydrogen, preferably hydrogen, and x is an integer from 0 to 10, preferably 0 to 3;

or formula (II):

Formula II

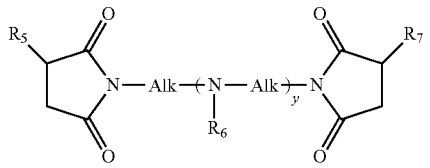

wherein $R_5$ and $R_7$ are both substantially hydrocarbon Chain having a molecular weight from about 450 to 3000, that is, $R_5$ and $R_7$ are hydrocarbyl chain, preferably an alkenyl chain, containing about 30 to about 200 carbon atoms; Alk is an alkylene chain of 2 to 10, preferably 2 to 6, carbon atoms, $R_6$ is selected from a $C_1$-$C_4$ alkyl or alkoxy or hydrogen, preferably hydrogen, and y is an integer from 0 to 10, preferably 0 to 3. In one embodiment, $R_1$, $R_5$ and $R_7$ are polyisobutyl groups.

In one embodiment, the actual reaction product of alkylene or alkenylene succinic acid or anhydride and alkylene polyamine will comprise the mixture of compounds including monosuccinimides and bissuccinimides. The mono alkenyl succinimide and bis alkenyl succinimide produced may depend on the charge mole ratio of polyamine to succinic groups and the particular polyamine used. Charge mole ratios of polyamine to succinic groups of about 1:1 may produce predominantly mono alkenyl succinimide. Charge mole ratios of polyamine to succinic group of about 1:2 may produce predominantly bis alkenyl succinimide. Examples of succinimide dispersants include those described in, for example, U.S. Pat. Nos. 3,172,892, 4,234,435 and 6,165,235, which are herein fully incorporated by reference.

In one embodiment, the polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

In a preferred aspect, the alkenyl succinimide may be prepared by reacting a polyalkylene succinic anhydride with an alkylene polyamine. The polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation. Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112,507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. EP 355 895; terpolymer PIBSA described in U.S. Pat. No. 5,792,729; sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863. The disclosures of each of these documents are incorporated herein by reference in their entirety. The polyalkylene succinic anhydride is preferably a polyisobutenyl succinic anhydride. In one preferred embodiment, the polyalkylene succinic anhydride is a polyisobutenyl succinic anhydride that is derived from a polyisobutylene having a number average molecular weight of 1200 or less, preferably from 400 to 1200, preferably from 500 to 1100, from 550 to 1100, from 600 to 1100, from 650 to 1100, from 700 to 1100, from 750 to 1100, from 800 to 1000, from 850 to 1000, from 900 to 1000, and from 950 to 1000.

The preferred polyalkylene amines used to prepare the succinimides are of the formula (III):

Formula III

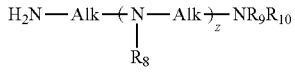

wherein z is an integer of from 0 to 10 and Alk is an alkylene radical of 2 to 10, preferably 2 to 6, carbon atoms, $R_8$, $R_9$, and $R_{10}$ are as are selected from a $C_1$-$C_4$ alkyl or alkoxy or hydrogen, preferably hydrogen, and z is an integer from 0 to 10, preferably 0 to 3.

The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline, 4-methyl imidazoline, N,N-dimethyl-1,3-propane diamine, 1,3-bis(2-aminoethyl)imidazoline, 1-(2-aminopropyl)-piperazine, 1,4-bis(2-aminoethyl)piperazine and 2-methyl-1-(2-aminobutyl) piperazine. Higher homologs such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk-Othmer, Vol. 5, pp. 898-905 (Interscience Publishers, New York, 1950). The term "ethylene amine" is used in a generic sense to denote a class of polyamines conforming for the most part to the formula (IV):

$$H_2N(CH_2CH_2NH)_\alpha H \qquad \text{Formula IV}$$

wherein $\alpha$ is an integer from 1 to 10. In one embodiment, $\alpha$ is an integer 3 to 5. Thus, it includes, for example, ethylene diamine, diethylene triamine, triethylene tetraamine, tetraethylene pentamine, pentaethylene hexamine, and the like.

The individual alkenyl succinimides used in the alkenyl succinimide composition of the present invention can be prepared by conventional processes, such as disclosed in U.S. Pat. Nos. 2,992,708; 3,018,250; 3,018,291; 3,024,237; 3,100,673; 3,172,892; 3,202,678; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

Also included within the term "alkenyl succinimides" are post-treated succinimides such as post-treatment processes involving borate or ethylene carbonate disclosed by Wollenberg, et al., U.S. Pat. No. 4,612,132; Wollenberg, et al., U.S. Pat. No. 4,746,446; and the like as well as other post-treatment processes each of which are incorporated herein by reference in its entirety. Preferably, the carbonate-treated alkenyl succinimide is a polybutene succinimide derived from polybutenes having a molecular weight of 450 to 3000, preferably from 900 to 2500, more preferably from 1300 to 2300, and preferably from 2000 to 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as taught in U.S. Pat. No. 5,716,912 incorporated herein by reference.

In one embodiment, the dispersant system comprises from 1 to 20 wt. %, preferably 1-15 wt. %, preferably 1-10 wt. %, preferably 1-8 wt. %, preferably 1-6 wt. %, preferably 1-5 wt. %, preferably 1-4.4 wt. %, preferably 1-4 wt. %, preferably 1-3 wt. %, preferably 1.5-4.0 wt. %, preferably 1.5-3.5 wt. %, preferably 1.5-3.0 wt. %, and preferably 2.0-3.0 wt. %, of the weight of the lubricating oil composition.

In another embodiment, the non-post treated dispersant is a non-post treated succindinimde dispersant. In other embodiments, the non-post treated succindinimde dispersant is present at 0.3 to 8 wt. %, 0.3 to 5 wt. %, 0.3 to 4.4 wt. %, 0.5 to 4.4 wt. %, 0.5 to 3.0 wt. %, 0.6 to 2.0 wt. % in the lubricating oil composition.

The individual alkenyl succinimides used in the alkenyl succinimide composition of the present invention can be prepared by conventional processes, such as disclosed in U.S. Pat. Nos. 2,992,708; 3,018,250; 3,018,291; 3,024,237; 3,100,673; 3,172,892; 3,202,678; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

Also included within the term "alkenyl succinimides" are post-treated succinimides such as post-treatment processes involving borate or ethylene carbonate disclosed by Wollenberg, et al., U.S. Pat. No. 4,612,132; Wollenberg, et al., U.S. Pat. No. 4,746,446; and the like as well as other post-treatment processes each of which are incorporated herein by reference in its entirety. Preferably, the carbonate-treated alkenyl succinimide is a polybutene succinimide derived from polybutenes having a molecular weight of 450 to 3000, preferably from 600 to 2500, preferably from 700 to 2500, preferably from 800 to 2500, preferably from 900 to 2500, more preferably from 900 to 2400, and preferably from 900 to 2300, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as taught in U.S. Pat. No. 5,716,912 incorporated herein by reference.

In one embodiment, the dispersant is not post treated. In another embodiment, the dispersant is post treated with a boron compound.

In one aspect, boron is present at less than 500, less than 450, less than 400, less than 350, less than 300, less than 250, less than 200, less than 150, less than 100 wt. ppm the lubricating oil composition.

Phosphoric/Phosphorous Acid

In one embodiment, inorganic phosphoric acid or phosphorous acid is present in the lubricating oil composition. In another embodiment, the acid is phosphoric acid.

In one embodiment, the inorganic phosphoric acid or phosphorous acid is present from 75 to 90 wt. % in solution.

In one embodiment, the inorganic phosphoric acid or phosphorous acid is present at from 0.01 to 1.0 wt. % of the lubricating oil composition. In other embodiments, the inorganic phosphoric acid or phosphorous acid is present at from 0.01 to 0.5 wt. %, from 0.01 to 0.1 wt. % from 0.01 to 0.08 wt. %, 0.01 to 0.07 wt. %, 0.01 to 0.06 wt. %, 0.02 to 0.06 wt. %, 0.03 to 0.05 wt. % in the lubricating oil composition.

In one embodiment, the ratio of nitrogen of the non-post-treated succinimides to phosphorus of phosphoric acid in the lubricating oil composition is from 1.0 to 10.0. In other embodiments, the nitrogen/phosphorus ratio in the lubricating oil composition of the present invention is from 1.0 to 8.0, 1.0 to 6.0, 1.0 to 5.0, 1.0 to 4.0, 1.0 to 3.5, 1.0 to 3.0, 1.0 to 2.5, 1.5 to 2.5, 1.5 to 2.0.

In one embodiment, the total phosphorous content in the lubricating oil composition is 500 ppm or less.

Metal Detergent

In one embodiment, the lubricating oil composition contains a metal detergent compound. Some non-limiting examples of suitable metal detergent include sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Other non-limiting examples of suitable metal detergents include metal sulfonates, phenates, salicylates, phosphonates, thiophosphonates and combinations thereof. The metal can be any metal suitable for making sulfonate, phenate, salicylate or phosphonate detergents. Non-limiting examples of suitable metals include alkali earth metals, alkaline metals and transition metals. In some embodiments, the metal is Ca, Mg, Ba, K, Na, Li or the like.

Some suitable detergents have been described in Mortier et al., "*Chemistry and Technology of Lubricants,*" 2nd Edition, London, Springer, Chapter 3, pages 75-85 (1996); and Leslie R. Rudnick, "*Lubricant Additives: Chemistry and Applications*," New York, Marcel Dekker, Chapter 4, pages 113-136 (2003), both of which are incorporated herein by reference.

Generally, the amount of the metal detergent is from about 0.001 wt. % to about 5 wt. %, from about 0.01 wt. % to about 3 wt. %, from about 0.01 wt. % to about 2 wt. %, from about 0.01 wt. % to about 1 wt. %, about 0.02 wt. % to about 0.5 wt. %, about 0.02 wt. % to about 0.4 wt. %, or from about 0.03 wt. % to about 0.3 wt. %, based on the total weight of the lubricating oil composition.

In one embodiment, the metal detergent is a calcium sulfonate detergent with a TBN of 420 mg KOH/gm and a calcium content of 16 wt. %.

In another embodiment, calcium is present at no more than 350 wt. ppm in the lubricating oil composition. In other embodiments, calcium is present at 25 to 350, 30 to 340, 34 to 337 wt. ppm in the lubricating oil composition.

Friction Modifier

A variety of known friction modifiers can be used as the friction modifier contained in the lubricating oil composition of the present invention, but a low molecular weight $C_6$ to $C_{30}$ hydrocarbon-substituted succinimide, a fatty acid amide, or a polyol is preferable. The friction modifier can be used singly or as a combination of friction modifiers. In some aspects, the friction modifier is present in an amount of from 0.01 to 5 wt. % in the lubricating oil composition. In other aspects, the friction modifier is present in an amount of from 0.01 to 3.0, from 0.01 to 2.0 wt. %, from 0.01 to 1.5, from 0.01 to 1.0, from 0.01 to 1.0, in the lubricating oil composition (FM1): Succinimide Friction Modifier:

In one aspect of the invention, the friction modifier of the invention is bis succinimide.

In one aspect of the invention, the bis succinimide friction modifier of the invention is an alkenyl-substituted succinimide represented by the formula (V) or a post-treated derivative thereof:

(V)

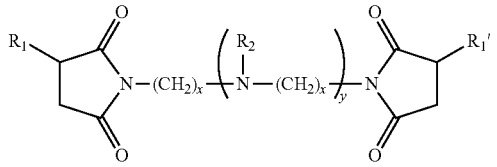

in which each of $R_1$ and $R_1'$ independently is an alkenyl group having a branch structure in β-position which is represented by the following formula (VI), $R_2$ is a hydrogen atom, an alkyl group having 1 to 12 carbon atoms, an aryl group having 6 to 12 carbon atoms, an aralkyl group having 7 to 13 carbon atoms, or a 5-8 membered heterocyclic group, x is an integer of 1 to 6, and y is an integer of 0 to 20:

(VI)

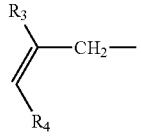

in which each of $R_3$ and $R_4$ is an aliphatic hydrocarbyl group and a total carbon atom number of $R_3$ and $R_4$ is in the range of 3 to 45, under the condition that a carbon atom number of $R_3$ is larger than a carbon atom number of $R_4$ by 3 or a carbon atom number of $R_3$ is smaller than a carbon atom number of $R_4$ by 1.

In another aspect, the invention resides in a friction modifier comprising an alkenyl-substituted succinimide of the following formula (VII) or a post-treated derivative thereof:

(VII)

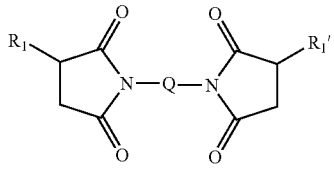

in which each of $R_1$ and $R_1'$ independently is an alkenyl group having a branch structure in β-position which is derived from a dimer of a single linear α-olefin having 3 to 24 carbon atoms, and Q is a residue of an alkylene-polyamine having 1 to 20 carbon atoms and containing an amino group at least at each terminal thereof.

The friction modifier provided by the invention is effective to impart improved friction performance as evidenced by an increased friction coefficient and a prolonged friction coefficient stability to a lubricating oil composition. Therefore, a lubricating oil composition containing the friction modifier of the invention can keep an automatic transmission from shuddering for a relatively long period of time.

The friction modifier of the invention can be an alkenyl-substituted succinimide represented by the aforementioned formula (V) or (VII) per se. Otherwise, the friction modifier can be a post-treated alkenyl-substituted succinimide which is obtained by post-treatment of the alkenyl-substituted succinimide with a known post-treating agent such as boric acid, phosphoric acid, a carboxylic acid or ethylene carbonate.

(FM2): Ethoxylated Amine

In one aspect of the invention, the friction modifier of the invention is an ethoxylated amine.

R—N(C2H4OH)2 (VIII)

In the general formula (VIII), R represents hydrogen, an alkyl group or an alkenyl group. It is also possible to use a mixture of a compound having different alkyl or alkenyl groups. The alkyl or alkenyl groups can either be straight or branched, and the preferred number 8-22 carbon atoms.

(FM3): Polyol:

In one aspect of the invention, the polyol of the invention is a diol compound represented by Formula (IX) below.

(IX)

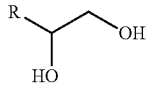

In the general formula (IX), R represents hydrogen, an alkyl group or an alkenyl group. It is also possible to use a mixture of a compound having different alkyl or alkenyl groups. The alkyl or alkenyl groups can either be straight or branched, and the preferred number 10-30 carbon atoms.

Phosphorus Compounds

The phosphorus compounds can be those which are known as anti-wear agents employable in the lubricating oil compositions. Examples of the phosphorus compound include phosphoric acid, a phosphoric acid ester, phosphorous acid, a phosphorous acid ester, thiophosphoric acid and a thiophosphoric acid ester. Also employable are amine salts of the phosphoric acid ester and phosphorous acid ester.

Examples of the phosphate esters include triaryl phosphates, trialkyl phosphates, trialkylaryl phosphalkyl phosphates, triarylalkyl phosphates, and trialkenyl phosphates. Specific examples include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, di(ethylphenyl)phenyl phosphate, propylphenyl diphenyl phosphate, di(propylphenyl)phenyl phosphate, triethylphenyl phosphate, tripropylphenyl phosphate, butylphenyl diphenyl phosphate, di(butylphenyl)phenyl phosphate, tributylphenyl phosphate, trihexyl phosphate, tri(2-ethylhexyl)phosphate, tridecyl phosphate, trilauryl phosphate, trimyristyl phosphate, tripalmityl phosphate, tristearyl phosphate, and trioleyl phosphate.

Examples of the acid phosphate esters include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

Examples of the phosphite esters include triethyl phosphite, tributyl phosphite, triphenyl phosphite, tricresyl phosphite, tri(nonylphenyl)phosphite, tri(2-ethylhexyl)phosphite, tridecyl phosphite, trilauryl phosphite, triisooctyl phosphite, diphenyl isodecyl phosphite, tristearyl phosphite, trioleyl phosphite, dibutyl hydrogen phosphite, dilauryl hydrogen phosphite, dioleyl hydrogen phosphite, distearyl hydrogen phosphite, and diphenyl hydrogen phosphite. Among these phosphoric acid esters, tricresyl phosphate and triphenyl phosphate are preferred.

Examples of the amines which form amine salts with the phosphoric acid esters include monosubstituted amines, disubstituted amines, and trisubstituted amines. Examples of the monosubstituted amines include butylamine, pentylamine, hexylamine, cyclohexylamine, octylamine, laurylamine, stearylamine, oleylamine, and benzylamine. Examples of the disubstituted amines include dibutylamine, dipentylamine, dihexylamine, dicyclohexylamine, dioctylamine, dilaurylamine, distearylamine, dioleylamine, dibenzylamine, stearylmonoethanolamine, decylmonoethanolamine, hexylmonopropanolamine, benzylmonoethanolamine, phenylmonoethanolamine, and tolylmonopropanolamine. Examples of the trisubstituted amines include tributylamine, tripentyl amine, trihexylamine, tricyclohexylamine, trioctylamine, trilaurylamine, tristearylamine, trioleylamine, tribenzylamine, dioleylmonoethanolamine, dilaurylmonopropanolamine, dioctylmonoethanolamine, dihexylmonopropanolamine, dibutylmonopropanolamine, oleyldiethanolamine, stearyldipropanolamine, lauryldiethanolamine, octyldipropanolamine, butyldiethanolamine, benzyldiethanolamine, phenyldiethanolamine, tolyldipronanolamine, xylyldiethanolamine, triethanolamine, and tripropanolamine.

Examples of thiophosphoric acid esters include alkyl trithiophosphites, aryl or alkylaryl thiophosphates, and zinc dialkyl dithiophosphates. Of these, lauryl trithiophosphite, triphenyl thiophosphate, and zinc dilauryl dithiophosphate are particularly preferred.

These extreme-pressure agents may be used singly or in combination of two or more species and are generally used in an amount of 0.01 to 10 mass %, based on the total amount of a transmission fluid composition, preferably 0.05 to 5 mass, from the viewpoint of, for example, balance between the effect and the cost.

In one embodiment, the phosphorous compound is an amine salt phosphate compound, an aromatic hydrogen phosphate compound, or combinations thereof.

In one aspect, the amine salt phosphate compound is present at 0.01 to 0.5, 0.02 to 0.3, 0.02 to 0.2, 0.03 to 0.02, 0.04 to 0.02, 0.05 to 0.18, 0.05 to 0.15 wt. % in the lubricating oil composition.

In another aspect, the combination of the amine salt phosphate and the aromatic hydrogen phosphate compounds in the lubricating oil composition is at 0.01 to 0.5, 0.02 to 0.3, 0.02 to 0.2, 0.03 to 0.2, 0.04 to 0.2, 0.05 to 0.2, 0.05 to 0.20 wt. %.

In one embodiment, the total phosphorus in the lubricating oil composition is 500 ppm or less. In one embodiment, the total phosphorus in the lubricating oil composition is 450, 425, 400 ppm or less. In one embodiment, the total phosphorus in the lubricating oil composition is 450 to 50, 450 to 100, 450 to 150, 400 to 50, 400 to 100, 400 to 150, ppm.

In one embodiment, the lubricating oil composition contains a sulfur based extreme pressure agent. In another embodiment, the lubricating oil composition does not contain a sulfur based extreme pressure agent.

Other Additives

Optionally, the lubricating oil composition may further comprise at least an additive or a modifier (hereinafter designated as "additive") that can impart or improve any desirable property of the lubricating oil composition. Any additive known to a person of ordinary skill in the art may be used in the lubricating oil compositions disclosed herein. Some suitable additives have been described in Mortier et al., "*Chemistry and Technology of Lubricants,*" 2nd Edition, London, Springer, (1996); and Leslie R. Rudnick, "*Lubricant Additives: Chemistry and Applications*," New York, Marcel Dekker (2003), both of which are incorporated herein by reference. In some embodiments, the additive can be selected from the group consisting of antioxidants, anti-wear agents, detergents, rust inhibitors, demulsifiers, friction modifiers, multi-functional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof. In general, the concentration of each of the additives in the lubricating oil composition, when used, may range from about 0.001 wt. % to about 15 wt. %, from about 0.01 wt. % to about 10 wt. %, or from about 0.1 wt. % to about 8 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 8 wt. %, based on the total weight of the lubricating oil composition.

Optionally, the lubricating oil composition disclosed herein can further comprise an antioxidant that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines, phenyl-α-naphthylamine, alkyl or aralkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York, Marcel Dekker, Chapter 1, pages 1-28 (2003), which is incorporated herein by reference.

The lubricating oil composition disclosed herein can optionally comprise a pour point depressant that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "*Chemistry and Technology of Lubricants,*" 2nd Edition, London, Springer, Chapter 6, pages 187-189 (1996); and Leslie R. Rudnick, "*Lubricant Additives: Chemistry and Applications*," New York, Marcel Dekker, Chapter 11, pages 329-354 (2003), both of which are incorporated herein by reference.

The lubricating oil composition disclosed herein can optionally comprise a foam inhibitor or an anti-foam that can break up foams in oils. Any foam inhibitor or anti-foam known by a person of ordinary skill in the art may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.0001 wt. % to about 1 wt. %, from about 0.0005 wt. % to about 0.5 wt. %, or from about 0.001 wt. % to about 0.1 wt. %, based on the total weight of the lubricating oil composition. Some suitable anti-foams have been described in Mortier et al., "*Chemistry and Technology of Lubricants,*" 2nd Edition, London, Springer, Chapter 6, pages 190-193 (1996), which is incorporated herein by reference.

The lubricating oil composition disclosed herein can optionally comprise a corrosion inhibitor that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines, benzotriazoles, thiadiazoles and combinations thereof. The amount of the corrosion inhibitor may vary from about 0.001 wt. % to about 5 wt. %, from about 0.005 wt. % to about 1 wt. %, or from about 0.005 wt. % to about 0.5 wt. %, based on the total weight of the lubricating oil composition. Some suitable corrosion inhibitors have been described in Mortier et al., "*Chemistry and Technology of Lubricants,*" 2nd Edition, London, Springer, Chapter 6, pages 193-196 (1996), which is incorporated herein by reference.

The lubricating oil composition disclosed herein can optionally comprise an extreme pressure (EP) agent that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "*Lubricant Additives: Chemistry and Applications*," New York, Marcel Dekker, Chapter 8, pages 223-258 (2003), which is incorporated herein by reference.

In one embodiment, the lubricating oil composition contains no sulfur based extreme agent.

The lubricating oil composition disclosed herein can optionally comprise a rust inhibitor that can inhibit the corrosion of ferrous metal surfaces. Any rust inhibitor known by a person of ordinary skill in the art may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha,omega-dicarboxylic acids having a molecular weight in the range of 600 to 3000 daltons and combinations. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

In some embodiments, the lubricating oil composition comprises at least a multifunctional additive. Some non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

In certain embodiments, the lubricating oil composition comprises at least a viscosity index improver. Some non-limiting examples of suitable viscosity index improvers include polymethacrylate type polymers, ethylene-propylene copolymers, styrene-isoprene copolymers, hydrated styrene-isoprene copolymers, polyisobutylene, and dispersant type viscosity index improvers.

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity from about 13 centistokes to about 35 centistokes at 40° C.

Generally, it is desired that the diluent readily solubilizes the lubricating oil soluble additive of the invention and provides an oil additive concentrate that is readily soluble in the lubricant base oil stocks or fuels. In addition, it is desired that the diluent not introduce any undesirable characteristics, including, for example, high volatility, high viscosity, and impurities such as heteroatoms, to the lubricant base oil stocks and thus, ultimately to the finished lubricant or fuel.

The present invention further provides an oil soluble additive concentrate composition comprising an inert diluent and from 2.0% to 90% by weight, preferably 10% to 50% by weight based on the total concentrate, of an oil soluble additive composition according to the present invention.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

EXAMPLES

Dispersant 1: Non-postreated Bis-succinimide derived from MW 950 PIB, N 2.0 wt. %.

Dispersant 2: borated bis-succinimide derived from MW 950 PIB.

Dispersant 3: borated bis-succinimide derived from MW 1300 PIB

Phosphoric acid: 85 wt. % $H_3PO_4$, P 27 wt. %.

Detergent: Ca sulfonate, TBN 420, Ca 16 wt. %.

Friction modifier 1 (FM1): Bis succinimide friction modifier.

Friction modifier 2 (FM2): Ethoxylated amine.

Friction modifier 3 (FM3): Polyol.

Phosphorus compound 1(P1): Amine salt of phosphate.

Phosphorus compound 2(P2): Aromatic hydrogen phosphite.

Base oil: Group 2 base oil.

Antioxidant(s): A mixture of phenolic and aminic antioxidant.

Corrosion inhibitor: Thiadiazole or Triazole.

Seal Swell: Ester type seal swell.

VII: dispersant Polymethacrylate (PMA).

Lubricating oil compositions were prepared according to Inventive Examples 1 to 4 and Comparative Examples 1 to 5 and are summarized in Table 1.

TABLE 1

| | Ex1 | Comp1 | Ex2 | Comp2 | Comp3 | Comp4 | Comp5 | Ex3 | Ex4 |
|---|---|---|---|---|---|---|---|---|---|
| Dispersant 1 | 1.0 | 1.0 | 0.8 | 0.8 | 0.8 | 0.8 | 1.6 | 1.6 | 0.8 |
| Dispersant 2 | 1.5 | 1.50 | — | — | — | — | — | — | — |
| Dispersant 3 | — | — | 1.2 | 1.2 | 1.2 | 1.2 | 1.2 | 1.2 | 1.2 |
| Phosphoric acid | 0.05 | — | 0.03 | — | — | 0.03 | 0.03 | 0.05 | 0.03 |
| Detergent | 0.045 | 0.045 | 0.03 | 0.03 | 0.03 | 0.03 | 0.21 | 0.21 | 0.021 |
| Antioxidant(s) | 0.8 | 0.8 | 0.8 | 0.8 | 0.8 | 0.8 | 0.8 | 0.8 | 0.8 |
| Corrosion inhibitor | 0.13 | 0.13 | 0.13 | 0.13 | 0.13 | 0.13 | 0.13 | 0.13 | 0.13 |
| Seal Swell | 0.4 | 0.4 | 0.4 | 0.4 | 0.4 | 0.4 | 0.4 | 0.4 | 0.4 |
| FM1 | 0.6 | 0.6 | — | — | — | — | — | — | — |
| FM2 | 0.03 | 0.03 | 0.6 | 0.6 | 0.6 | 0.6 | 0.6 | 0.6 | 0.6 |
| FM3 | 0.1 | 0.1 | — | — | — | — | — | — | — |
| P1 | 0.1 | 0.1 | 0.05 | 0.05 | 0.05 | — | 0.15 | 0.15 | 0.05 |
| P2 | 0.1 | 0.1 | 0.1 | 0.1 | 0.1 | — | 0.1 | 0.1 | 0.1 |

TABLE 1-continued

| | Ex1 | Comp1 | Ex2 | Comp2 | Comp3 | Comp4 | Comp5 | Ex3 | Ex4 |
|---|---|---|---|---|---|---|---|---|---|
| Foam inhibitor | 0.002 | 0.002 | 0.002 | 0.002 | 0.002 | 0.002 | 0.002 | 0.002 | 0.002 |
| VII | 3 | 3 | 3 | 3 | 3 | 3 | 3 | 3 | 3 |
| Base oil | 92.143 | 92.193 | 93.398 | 93.428 | 93.488 | 93.548 | 92.318 | 92.298 | 93.407 |
| Total Ca in composition, ppm | 75 | 75 | 50 | 50 | 50 | 48.2 | 337 | 337 | 33.7 |
| Total B in composition, ppm | 90 | 90 | 80 | 80 | 80 | 80 | 80 | 80 | 80 |
| Total P in composition, ppm | 350 | 210 | 260 | 180 | 180 | 81 | 340 | 394 | 258 |
| N from non-post treated succinimide | 200 | 200 | 160 | 160 | 160 | 160 | 320 | 320 | 160 |
| P from phosphoric acid | 135 | 0 | 81 | 0 | 0 | 81 | 81 | 135 | 81 |
| $N^1/P^2$ | 1.5 | — | 2.0 | — | — | 2.0 | 4.0 | 2.4 | 2.0 |

$N^1$: Nitrogen from non post-treated succinimide
$P^2$: phosphorous from phosphoric acid Inventive Examples 1 to 4 and Comparative Examples 1 to 5 were evaluated for Wet Clutch Anti-Shudder Performance using the JASO M349-2012 test procedure. The results are in Table 2 below.

Wet Clutch Anti-Shudder Performance Test JASO M349-2012

The anti-shudder performance durability was determined by means of a low velocity friction apparatus according to "Road vehicles Test method for anti-shudder performance of automatic transmission fluids" described in JASO M-349: 2012. Details of the testing method are described below.

Testing Conditions

Friction material: cellulose disc/steel plate

Amount of oil: approx. 150 mL

Break-In Conditions

Contact pressure: 1 MPa

Oil temperature: 80° C.

Sliding velocity: 0.6 m/s

Sliding time: 30 minutes

μ-V Performance Test Conditions

Contact pressure: 1 MPa

Oil temperature: 40, 80, 120° C.

Sliding velocity: continuously increasing and decreasing between 0 m/s to 1.5 m/s Durability Test Conditions Contact pressure: 1 MPa Oil temperature: 120° C.

Sliding velocity: 0.9 m/s

Time: 30 minutes

Rest time: 1 minute

Performance measurement time: μ-V characteristics was measured every 24 hour (or 6 hour if necessary due to, for example, clutch failure) from 0 hour Note: The anti-shudder performance was evaluated by determining a period of time until dμ/dV at 0.9 m/s reached 0. The longer the determined period of time is, the better the anti-shudder performance is.

TABLE 2

Results for anti-shudder performance

| | Ex1 | Comp 1 | Ex2 | Comp 2 | Comp 3 | Comp 4 | Comp 5 | Ex3 | Ex4 |
|---|---|---|---|---|---|---|---|---|---|
| Time (hrs) | 6 | 6 | 6 | 6 | 6 | 6 | 6 | 6 | 6 |
| 0.3 m/s, Friction Coefficient | 0.144 | 0.15 | 0.134 | 0.142 | 0.182 | 0.130 | 0.137 | 0.137 | 0.129 |
| 0.9 m/s, Friction Coefficient | 0.143 | 0.146 | 0.136 | 0.141 | 0.169 | 0.134 | 0.141 | 0.141 | 0.136 |
| dμ/dv (0.30)x1000 | 5.16 | −3.93 | 15.67 | 3.78 | −26.42 | 16.55 | 19.57 | 21.69 | 31.33 |
| dμ/dv (0.90)x1000 | 1.24 | −4.93 | 1.67 | −1.02 | −15.37 | 3.12 | 2.32 | 25.12 | 6.07 |
| Status | Continue | Continue | Continue | Continue | Continue | Continue | Continue | Continue | Continue |
| Time (hrs) | 24 | 24 | 24 | 24 | 24 | 24 | 24 | 24 | 24 |
| 0.3 m/s, Friction Coefficient | 0.138 | 0.142 | 0.135 | 0.147 | 0.183 | 0.136 | 0.139 | 0.140 | 0.124 |

TABLE 2-continued

| Results for anti-shudder performance | | | | | | | | | |
|---|---|---|---|---|---|---|---|---|---|
| | Ex1 | Comp 1 | Ex2 | Comp 2 | Comp 3 | Comp 4 | Comp 5 | Ex3 | Ex4 |
| 0.9 m/s, Friction Coefficient | 0.141 | 0.141 | 0.137 | 0.142 | 0.170 | 0.137 | 0.141 | 0.143 | 0.132 |
| dμ/dv (0.30)x1 000 | 24.85 | 8.45 | 16.18 | −5.61 | −27.93 | 9.27 | 19.86 | 19.53 | 37.15 |
| dμ/dv (0.90)x1 000 | 0.72 | −2.61 | 0.40 | −6.04 | −16.21 | −1.23 | 1.22 | 0.79 | 7.25 |
| Status | Continue | Stop | Continue | Stop | Stop | Stop | Continue | Continue | Continue |
| Time (hrs) | 360 | — | 144 | — | — | — | 48 | 96 | 72 |
| 0.3 m/s, Friction Coefficient | 0.166 | — | 0.145 | — | — | — | 0.141 | 0.149 | 0.126 |
| 0.9 m/s, Friction Coefficient | 0.167 | — | 0.146 | — | — | — | 0.141 | 0.149 | 0.128 |
| dμ/dv (0.30)x1 000 | 19.33 | — | 2.74 | — | — | — | 13.54 | 7.88 | 24.29 |
| dμ/dv (0.90)x1 000 | 0.55 | — | 0.14 | — | — | — | −1.03 | 0.11 | 0.38 |
| Status | Continue | — | Continue | — | — | — | Stop at 48 Hrs. | Continue (102 Hrs stop) | Continue (78 Hrs stop) |

Examples 1-4 show excellent improved anti-shutter performance over Comparative Examples 1-5, where dμ/dv for the inventive examples are positive even after 48 hrs.

Metal-Metal Friction and Wear Test (JASO M358-2005):

The friction coefficients for Inventive Examples 1 to 4 and Comparative Examples 1 were determined in terms of a metal-metal friction coefficient by means of a block-on-ring tester according to "Standard test method for metal on metal friction characteristics of belt CVT fluids" described in JASO M358:2005. Details of the testing method are described below.

Testing Conditions

Ring: Falex S-10 Test Ring (SAE 4620 Steel)

Block: Falex 14-60 Test Block (SAE 01 Steel)

Amount of Oil

Approx. 110 mL (Test oil level is center of test ring)

Break-In Conditions

Oil temperature: 110° C.

Load: 5 min. under 890 N and 25 min, under 1112 N

Sliding velocity: 5 min. at 0.5 m/s-25 min. at 1.0 m/s

Testing Conditions

Oil temperature: 110° C.

Load: 1112 N

Sliding velocity: 5 min. each at 1.0, 0.5, 0.25, 0.125, 0.075, 0.025 m/s

Friction coefficient: a friction coefficient for 30 sec, before the change of the sliding velocity The results are in Table 3 below.

TABLE 3

| Friction Coefficient and Wear Test Results | | | | | | | | | |
|---|---|---|---|---|---|---|---|---|---|
| Sliding Speed | Ex1 | Comp1 | Ex2 | Comp2 | Comp3 | Comp4 | Comp5 | Ex3 | Ex4 |
| 0.0025 m/s | 0.128 | 0.125 | 0.122 | 0.124 | 0.138 | 0.116 | 0.133 | 0.132 | 0.132 |
| 0.0075 m/s | 0.126 | 0.122 | 0.117 | 0.119 | 0.138 | 0.112 | 0.133 | 0.132 | 0.132 |
| 0.125 m/s | 0.124 | 0.118 | 0.113 | 0.111 | 0.135 | 0.108 | 0.132 | 0.131 | 0.132 |
| 0.25 m/s | 0.121 | 0.113 | 0.107 | 0..102 | 0.131 | 0.099 | 0.131 | 0.130 | 0.131 |
| 0.5 m/s | 0.117 | 0.105 | 0.096 | 0.084 | 0.126 | 0.088 | 0.130 | 0.128 | 0.128 |
| 1.0 m/s | 0.110 | 0.097 | 0.086 | 0.073 | 0.117 | 0.073 | 0.127 | 0.123 | 0.124 |
| Test Ring Weight Loss (mg) | <1.0 | <1.0 | <1.0 | <1.0 | <1.0 | <1.0 | <1.0 | <1.0 | <1.0 |

TABLE 3-continued

Friction Coefficient and Wear Test Results

| Sliding Speed | Ex1 | Comp1 | Ex2 | Comp2 | Comp3 | Comp4 | Comp5 | Ex3 | Ex4 |
|---|---|---|---|---|---|---|---|---|---|
| Test Block Weight Loss (mg) | <1.0 | <1.0 | <1.0 | <1.0 | <1.0 | <1.0 | <1.0 | <1.0 | <1.0 |
| Note | No Scuff | No Scuff | No Scuff | No Scuff | No Scuff | Scoring (Block & Ring surfaces) | No Scuff | No Scuff | No Scuff |

Note
Less than 1.0 mg wear loss is small.

The data show that wear loss of the test ring and block are small for every test oils, but the test oil without organic phosphorus compounds, Comp Example 4, gives both ring and block surface damage. There is a shortage of load carrying capacity performance when organic phosphorus compounds is not present, and this results in surface damage which is not acceptable for gear lubricants.

It will be understood that various modifications may be made to the embodiments disclosed herein. Therefore, the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising:

a) a major amount of oil of lubricating viscosity, b) 0.3 to 4.4 wt. %, based on the total weight of the lubricating oil composition, of one or more non-post treated polyisobutyl-substituted succinimide dispersants, wherein the polyisobutyl group is derived from polyisobutene having a number average molecular weight of from about 400 to about 1,200, c) 0.01-0.5 wt. % phosphoric acid, d) a calcium detergent providing from 25 ppm to no more than 350 ppm of calcium to the composition, and e) 0.01 to 0.5 wt. % %, based on the total weight of the lubricating oil composition, of one or more organic phosphorus compounds, wherein the one or more organic phosphorous compounds are selected from the group consisting of an amine salt phosphate and an aromatic hydrogen phosphite, wherein the ratio of nitrogen from the non-post treated succinimide to the phosphorous from phosphoric acid is 1 to 3.

2. The lubricating oil composition of claim 1, wherein the composition is an automatic transmission or a continuously variable transmission composition.

3. The lubricating oil composition of claim 2, wherein the automatic transmission or continuously variable transmission is equipped with a wet paper clutch.

4. The lubricating oil composition of claim 3, wherein the wet clutch contains cellulose fiber and/or aramid fiber.

5. The lubricating oil composition of claim 1, wherein the calcium detergent provides 30 to 350 wt. ppm calcium to the lubricating oil composition.

6. The lubricating oil composition of claim 1, wherein the one or more non-post treated succinimide dispersant is present at from 0.3-3 wt. %.

7. The lubricating oil composition of claim 1, wherein the one or more non-post treated polyisobutyl succinimide dispersants is a bis-succinimide.

8. The lubricating oil composition of claim 1, wherein the bis-succinimide is derived from 950 molecular weight polyisobutylene (PIB).

9. The lubricating oil composition of claim 1, further comprising a borated bis-succinimide derived from 900 to 1500 molecular weight polyisobutylene (PIB).

10. The lubricating oil composition of claim 1, wherein the organic phosphorous compound provides from 0.01 to 0.3 wt. % phosphorous to the lubricating oil composition.

11. The lubricating oil composition of claim 1, wherein the total phosphorus in the lubricating oil composition is 500 ppm or less.

12. A method of improving anti-shudder performance and reducing friction in a combustion engine equipped with an automatic transmission or a continuously variable transmission comprising lubricating said transmission with a lubricating oil composition comprising:

a) a major amount of oil of lubricating viscosity, b) 0.3 to 4.4 wt. %, based on the total weight of the lubricating oil composition, of one or more non-post treated polyisobutyl-substituted succinimide dispersants, wherein the polyisobutyl group is derived from polyisobutene having a number average molecular weight of from about 400 to about 1,200, c) 0.01-0.5 wt. % phosphoric acid, d) a calcium detergent providing from 25 ppm to no more than 350 ppm of calcium to the composition, and e) 0.01 to 0.5 wt. % %, based on the total weight of the lubricating oil composition, of one or more organic phosphorus compounds, wherein the one or more organic phosphorous compounds are selected from the group consisting of an amine salt phosphate and an aromatic hydrogen phosphite, wherein the ratio of nitrogen from the non-post treated succinimide to the phosphorous from phosphoric acid is 1 to 3.

13. The method of claim 12, wherein the automatic transmission or continuously variable transmission is equipped with a wet paper clutch.

14. The method of claim 12, wherein the one or more non-post treated succinimide dispersant is present at from 0.3-3 wt. %.

15. The method of claim 12, wherein the one or more non-post treated polyisobutyl succinimide dispersants is a bis-succinimide.

16. The method of claim 12, wherein the one or more organic phosphorous compound provides from 0.01 to 0.3 wt. % phosphorous to the lubricating oil composition.

17. The method of claim 12, wherein the total phosphorus in the lubricating oil composition is 500 ppm or less.

18. The lubricating oil composition of claim 1, wherein the calcium detergent is an overbased calcium sulfonate.

19. The method of claim 12, wherein the calcium detergent is an overbased calcium sulfonate.

20. The method of claim 12, wherein the lubricating oil composition further comprises a borated bis-succinimide derived from 900 to 1500 molecular weight polyisobutylene (PIB).

* * * * *